United States Patent [19]

Tiesler et al.

[11] Patent Number: 5,056,838

[45] Date of Patent: Oct. 15, 1991

[54] SOFT TOUCH DOOR HANDLE

[75] Inventors: Roy F. Tiesler, Troy; Mark L. Kaski, Royal Oak, both of Mich.

[73] Assignee: General Motors Corporation, Detroit, Mich.

[21] Appl. No.: 605,061

[22] Filed: Oct. 24, 1990

[51] Int. Cl.[5] ..... E05C 1/12

[52] U.S. Cl. ..... 292/336.3; 292/201; 292/347; 292/DIG. 63

[58] Field of Search ..... 292/144, 201, 216, 221, 292/336.3, 347, DIG. 31, DIG. 63; 70/275

[56] References Cited

U.S. PATENT DOCUMENTS

| | | | |
|---|---|---|---|
| 1,326,450 | 12/1919 | Howard et al. | 292/336.3 X |
| 2,763,888 | 9/1956 | Billeter | 292/144 X |
| 3,917,327 | 11/1975 | Plasko | 292/1 |
| 3,971,241 | 7/1976 | Parsson | 292/201 X |
| 3,999,792 | 12/1976 | Smith | 292/DIG. 63 X |
| 4,258,946 | 3/1981 | Angioletti | 292/144 |
| 4,541,258 | 9/1985 | Periou et al. | 70/263 |
| 4,762,345 | 8/1988 | Stluka et al. | 292/26 |

*Primary Examiner*—Richard E. Moore

*Attorney, Agent, or Firm*—Charles E. Leahy

[57] ABSTRACT

A recess is formed in the outside of the door and a fluid filled bladder such as a tubular hose is mounted in the recess. The bladder has an integral bellows portion formed on the end thereof which is distended from the bladder when pressure is imposed thereon by the vehicle user. A linkage is operably connected to the bellows portion of the bladder and adapted to release the door latch upon distention of the bellows portion from the bladder.

1 Claim, 1 Drawing Sheet

SOFT TOUCH DOOR HANDLE

FIELD OF THE INVENTION

This invention relates to a door handle for a vehicle and more particularly provides a fluid-filled bladder housed in a recess in the door and being distended when squeezed by the vehicle user to effect unlatching of the door latch.

BACKGROUND OF THE INVENTION

It is well known in motor vehicle doors to provide a latch for latching the door in the closed position. It is also well known to provide a handle on the outside of the vehicle which is connected to the door latch by a suitable linkage so that operating the handle will release the door latch to permit opening of the door.

Such handles are typically comprised of a lever which is rotated, or a button which is pushed, in order to actuate the linkage.

It would be desirable to provide a new and improved door handle arrangement which would be soft and pleasing to the touch of the vehicle operator.

SUMMARY OF THE INVENTION

According to the invention a recess is formed in the outside of the door and a fluid filled bladder such as a tubular hose is mounted in the recess. The bladder has an integral bellows portion formed on the end thereof which is distended from the bladder when pressure is imposed thereon by the vehicle user. A linkage is operably connected to the bellows portion of the bladder and adapted to release the door latch upon distention of the bellows portion from the bladder.

A BRIEF DESCRIPTION OF THE DRAWINGS

DESCRIPTION OF THE PREFERRED EMBODIMENT

Figure 1:
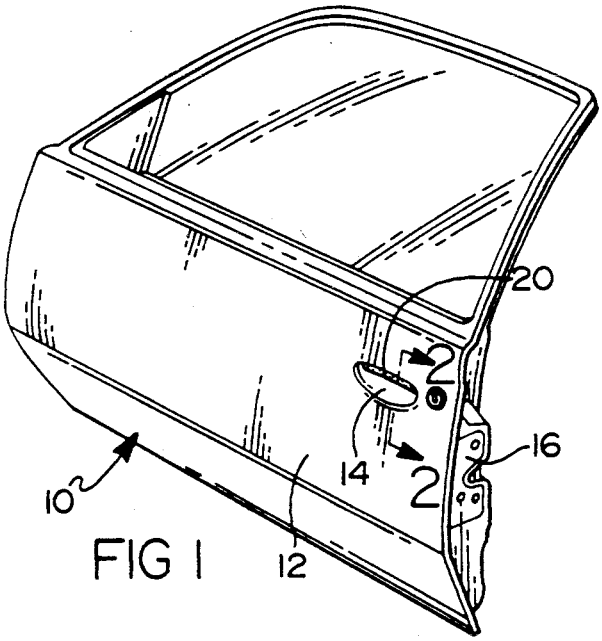
FIG. 1 is a perspective view of the vehicle door.

In FIG. 1 a door 10 has a recess 14 formed on the outer panel 12 thereof and a conventional door latch 16 mounted on the door for latching the door in a closed position with respect to a vehicle body.

Figure 2:
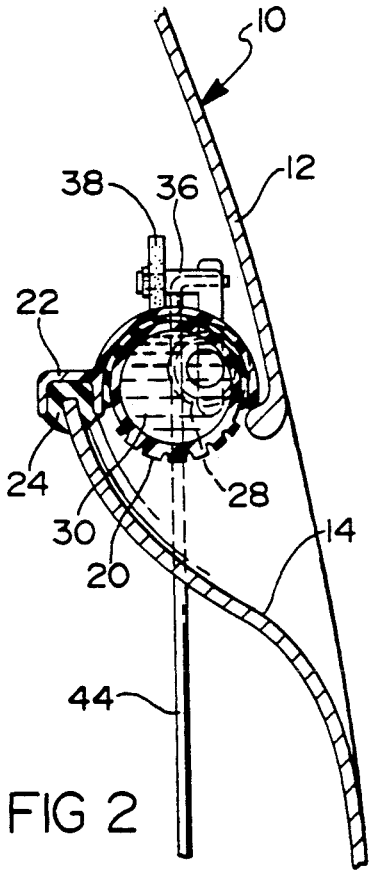
FIG. 2 is a section taken through the door and showing the fluid filled bladder mounted in a recess.
Figure 3:
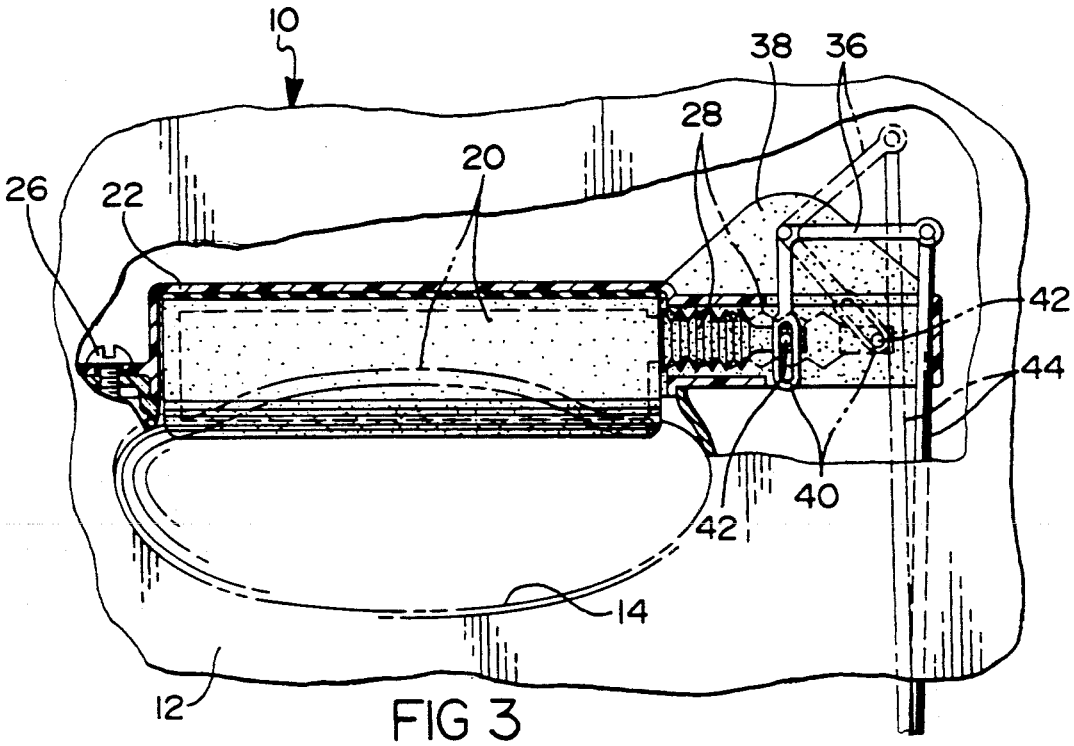
FIG. 3 is a side elevation view having parts broken away in a section and showing the phantom line indicating condition in which the door latch is released.

As seen in FIGS. 2 and 3, a bladder 20, such as a tubular hose, is mounted within the recess 14 by a mounting bracket 22 which is suitably attached to the door panel 12 as by a bead of adhesive 24 and screw 26. As seen in FIG. 3 the right hand end of the bladder 20 has an integrally formed bellows portion 28. The bladder 20 is filled with a suitable incompressible fluid 30, such as oil. As seen in FIGS. 2 and 3 the housing 22 substantially surrounds and captures the bladder 20 except for the underside of the bladder 20 which is accessible through the recess 14. The bellows portion 28 of the bladder 20 extends through an opening in the right hand end or the housing 22.

As best seen by reference to FIG. 3, the vehicle user may insert his hand through the recess 14 and then press upwardly on the underside of the bladder 20. This pressure imposed on the bladder 20 lifts the underside of the bladder 20 to its phantom line indicated position of FIG. 3 so that the fluid 30 is displaced into the bellows portion 28 as enabled by distention of the bellows portion 28 to the phantom line indicated position of FIG. 3.

As seen in FIGS. 2 and 3 a bell crank arm 36 is mounted on a tab 38 of bracket 22 and has a slotted end 40 which receives a pin 42 projecting from the bellows portion 28. A door latch operating rod 44 is pivotally connected to the other end of bell crank arm 36. Accordingly, as seen in FIG. 3, the right hand movement of the bellows portion 28 rotates the bell crank arm 36 and lifts the door latch operating rod 44 so that the door latch 16 will be released.

It will be appreciated that the fluid 30 filling the bladder 20 is selected to maintain a desired viscosity irrespective of the normal range of operating temperatures encountered by the vehicle. In addition, it will be appreciated that an electrical heating element may be associated with the bladder 20 in order to warm the fluid 30 so that the door handle will provide a pleasantly warm touch to the vehicle user.

Thus it is seen that the invention provides a new and improved door handle for a vehicle.

The embodiments of the invention in which an exclusive property or privilege is claimed are defined as follows:

1. A door latch handle for a vehicle door latched in the closed position for a door latch releasable to permit opening of the door, comprising:

a recess formed in the door, a fluid filled bladder mounted in the recess of the door, said bladder having a bellows portion formed integrally thereon and being distended from the bladder by pressure imposed thereon by a vehicle user reaching into the recess and pressing the bladder, and a linkage means operably connected to the bellows portion and adapted to release the door latch upon operation thereof by the distention of the bellows portion.

* * * * *